US010945461B2

(12) United States Patent
Juster et al.

(10) Patent No.: US 10,945,461 B2
(45) Date of Patent: Mar. 16, 2021

(54) METHOD AND DEVICE FOR EXECUTING AN E-VAPING DEVICE OPERATING SYSTEM, E-VAPING PROGRAMMING LANGUAGE, AND E-VAPING APPLICATION PROGRAMMING INTERFACE

(71) Applicant: Altria Client Services LLC, Richmond, VA (US)

(72) Inventors: Bernard Juster, Netanya (IL); Robert Levitz, North Miami Beach, FL (US)

(73) Assignee: ALTRIA CLIENT SERVICES LLC, Richmond, VA (US)

( * ) Notice: Subject to any disclaimer, the term of this patent is extended or adjusted under 35 U.S.C. 154(b) by 501 days.

(21) Appl. No.: 14/951,657

(22) Filed: Nov. 25, 2015

(65) Prior Publication Data

US 2016/0143361 A1 May 26, 2016

Related U.S. Application Data

(60) Provisional application No. 62/084,122, filed on Nov. 25, 2014.

(51) Int. Cl.
*A24F 47/00* (2020.01)
*H05B 1/02* (2006.01)

(52) U.S. Cl.
CPC ..... *A24F 47/008* (2013.01); *H05B 1/0244* (2013.01)

(58) Field of Classification Search
CPC ... A24F 47/008; H05B 1/0244; H05B 1/0297; H05B 3/0085; H05B 6/108
(Continued)

(56) References Cited

U.S. PATENT DOCUMENTS 5,025,984 A * 6/1991 Bird ..... G05D 23/1904 165/239
5,372,148 A * 12/1994 McCafferty ..... A24F 47/008 128/202.21

(Continued)

OTHER PUBLICATIONS

International Preliminary Report on Patentablity and Written Opinion dated May 30, 2017 for correspondinq Application PCT/IB2015/059125.

(Continued)

*Primary Examiner* — Tu B Hoang
*Assistant Examiner* — Masahiko Muranami
(74) *Attorney, Agent, or Firm* — Harness, Dickey & Pierce, P.L.C.

(57) ABSTRACT

An electronic vaping device includes a housing extending in a longitudinal direction, the housing including a mouth-end and a connection-end, a reservoir containing a pre-vapor formulation, the reservoir in the housing, a heating element in the housing, the heating element in fluid communication with the reservoir, the heating element configured to generate a vapor, and a rechargeable battery configured to power at least the heating element and any other potential power consuming element(s) such as electronic circuits. The electronic vaping device also includes a first memory having stored thereon computer readable instructions relating to an electronic vaping operating system (OS), and at least one processor configured to execute the OS computer readable instructions to execute the operating system, the operating system including a real-time kernel configured to operate the electronic vaping device, and execute object code related to electronic vaping device functionality.

13 Claims, 7 Drawing Sheets

(58) Field of Classification Search
USPC ..... 392/404, 386, 394, 399, 400, 401, 402, 392/403, 405, 406, 407, 409; 131/270, 131/272, 194
See application file for complete search history.

(56) References Cited

U.S. PATENT DOCUMENTS

| | | | | |
|---|---|---|---|---|
| 6,155,664 | A * | 12/2000 | Cook | B41J 2/17509 347/19 |
| 2003/0099158 | A1* | 5/2003 | De la Huerga | A61J 7/0084 368/10 |
| 2003/0168389 | A1* | 9/2003 | Astle | B01D 27/101 210/85 |
| 2011/0252248 | A1* | 10/2011 | Cameron | G06Q 10/04 713/300 |
| 2013/0192623 | A1 | 8/2013 | Tucker et al. | |
| 2013/0284192 | A1 | 10/2013 | Peleg et al. | |
| 2013/0298905 | A1* | 11/2013 | Levin | A24F 47/008 128/202.21 |
| 2013/0319439 | A1 | 12/2013 | Gorelick et al. | |
| 2013/0340775 | A1 | 12/2013 | Juster et al. | |
| 2014/0096782 | A1* | 4/2014 | Ampolini | A24F 47/008 131/328 |
| 2014/0174459 | A1* | 6/2014 | Burstyn | A24F 47/008 131/273 |

OTHER PUBLICATIONS

International Search Report and Written Opinion to corresponding Application No. PCT/IB15/59125 dated Mar. 29, 2016.
Extended European Search Report dated Aug. 20, 2018, for corresponding European Application No. 15863742.1.
Eurasian Official Notification dated Aug. 7, 2018 for corresponding Eurasian Application No. 201791169.
Eurasian Notification dated Nov. 14, 2019 for corresponding Eurasian Application No. 201791169/31.
Eurasian Official Notification dated Mar. 14, 2019 for corresponding Eurasian Application No. 201791169/31.
Chinese Office Action dated Jun. 5, 2019 for corresponding Chinese Application No. 201580074046.0.
Eurasian Official Notification dated Aug. 28, 2020 for corresponding Eurasian Application No. 201791169.
Chinese Office Action dated Mar. 5, 2020 for corresponding Chinese Application No. 201580074046.0.
Ukrainian Office Action dated Jun. 10, 2020 for corresponding Ukrainian Patent Application No. A201706311.
Israeli Office Action dated Apr. 26, 2020 for corresponding Israeli Application No. 252494.
Israeli Office Action dated Jun. 18, 2020 for corresponding Israeli Application No. 252494.
European Examination Report dated May 12, 2020 for corresponding European Application No. 15863742.1.

* cited by examiner

FIG. 8

| Acronym | Functional Package Name |
|---|---|
| VAP | Vapor Generation |
| LED | LED Driving |
| SWB | Switches & Buttons |
| TMR | Timer Processing |
| RPI | Reservoir Profile (cartridge, tank, liquid, etc.) |
| LOG | Logging and Statistics |
| EVT | Event Handling |
| SCH | Task Scheduling |
| COM | Host Communications |
| BAT | Battery, Charging |
| EVG | eVGL Processing |
| RRF | Reservoir Related Functions |
| CON | Console (text) I/O |
| IOC | I/O Configuration (sensors, etc.) |

METHOD AND DEVICE FOR EXECUTING AN E-VAPING DEVICE OPERATING SYSTEM, E-VAPING PROGRAMMING LANGUAGE, AND E-VAPING APPLICATION PROGRAMMING INTERFACE

CROSS-REFERENCE TO RELATED APPLICATION

This U.S. non-provisional application claims priority under 35 U.S.C. § 119 to U.S. Provisional Application No. 62/084,122 filed on Nov. 25, 2014 in the USPTO, the entire contents of which are incorporated herein by reference.

BACKGROUND

Field

The present disclosure relates to methods, systems, devices, and/or computer readable media related to electronic vaping devices configured to execute an electronic vaping operating system and object code written using an e-vaping programming language associated with the e-vaping operating system and an electronic vaping Application Programming Interface (API). Additionally, the present disclosure also relates to use of a specialized operating system, specialized programming language, and specialized API for standardization of e-vaping devices and elements thereof.

Description of Related Art

Many existing electronic vaping devices, also referred to as e-vaping devices, contain an application-specific integrated circuit (ASIC) that provides control logic for powering and operating elements included in the e-vaping device, such as vaporizers and batteries. Newer e-vaping devices have been developed that use software-programmable microcontrollers in place of the ASIC, which provide for additional complexity and flexibility in the operation and management of the e-vaping device.

However, these microcontrollers are often operated using customized product-specific software packages that are developed by the e-vaping device manufacturers themselves using their own proprietary languages, functions, and commands for use with specific e-vaping device models and/or specific microcontrollers. In addition, the software is often developed in a product-specific fashion based on the elements, functions, and needs for the respective e-vaping device, which can vary widely from product to product. As a result, the software and resulting microcontroller can be drastically different from manufacturer to manufacturer, and even from product to product.

Thus, current ASICs and microcontrollers in e-vaping devices do not accommodate for different elements in an e-vaping devices, such as different reservoirs, batteries, chargers, external software applications, etc., without being specially programmed and manufactured for each of the different elements.

SUMMARY

At least one example embodiment relates to an electronic vaping device including a housing extending in a longitudinal direction, the housing including a mouth-end and a connection-end, a reservoir containing a pre-vapor formulation, the reservoir in the housing, a heating element in the housing, the heating element in fluid communication with the reservoir, the heating element configured to generate a vapor, a rechargeable battery configured to power at least the heating element (and any other potential power consuming element(s), such as electronic circuits), a first memory having stored thereon computer readable instructions relating to an electronic vaping operating system (OS), and at least one processor configured to execute the OS computer readable instructions to execute the operating system, the operating system including a real-time kernel configured to operate the electronic vaping device, and execute object code related to electronic vaping device functionality.

In at least one example embodiment of the electronic vaping device, the at least one processor may be further configured to control vapor generation using the heating element and the reservoir based on the object code.

In at least one example embodiment of the electronic vaping device, a charging interface may be configured to interface the rechargeable battery and an external power source, and the at least one processor may be further configured to control charging of the rechargeable battery using the external power source through the charging interface based on the object code.

In at least one example embodiment of the electronic vaping device, at least one input/output element may include at least one of a light-emitting diode, a button, a switch, and an airflow sensor, and the at least one processor may be further configured to control the at least one input/output element based on the object code.

In at least one example embodiment of the electronic vaping device, the object code related to electronic vaping device functionality may include computer readable instructions for at least one of: electronic vaping device identification, powering on, powering off, power consumption, operating efficiency, heating element temperature control, reservoir pre-vapor formulation level detection, operating time, power reduction, power increase, battery charging control, user interface, communications, self-test, and e-vaping device monitoring.

In at least one example embodiment of the electronic vaping device, a reservoir interface may be configured to transfer data communications between the at least one processor and the reservoir, the reservoir may include a second memory configured to store reservoir profile information related to the pre-vapor formulation, and the at least one processor may be configured to receive the reservoir profile through the reservoir interface for storage in the first memory based on the operating system.

In at least one example embodiment of the electronic vaping device, the reservoir profile may include at least one of: pre-vapor formulation type, pre-vapor formulation identifier, vendor identifier, capacity, heating element configuration data, measurement capability, deliverable function amount, consumption capacity, and software capability.

In at least one example embodiment of the electronic vaping device, a host interface may be configured to transfer data communications between the at least one processor and an external computing device, and the at least one processor may be configured to receive data from the external computing device through the host interface for storage in the first memory based on the operating system.

In at least one example embodiment of the electronic vaping device, the data of the external computing device may include profile information associated with an owner of the electronic vaping device.

In at least one example embodiment of the electronic vaping device, the data received from the external computing device may include object code related to operating the electronic vaping device and the reservoir according to desired operational constraints.

In at least one example embodiment of the electronic vaping device, the housing may include a battery section and a reservoir section, and the first memory and the at least one processor may be disposed in the battery section.

In at least one example embodiment of the electronic vaping device, the housing may include a battery section and a reservoir section, and the first memory and the at least one processor may be disposed in the reservoir section.

In at least one example embodiment of the electronic vaping device, the object code may be based on source code written using an e-vaping programming language associated with the e-vaping operating system.

At least one example embodiment relates to a method for operating an electronic vaping device that may include executing, using at least one processor, an electronic vaping operating system, the operating system including a real-time kernel configured to operate the electronic vaping device, and executing, using the at least one processor, object code related to electronic vaping device functionality, the electronic vaping device functionality relating to at least one of a reservoir containing a pre-vapor formulation, the reservoir in a housing, a heating element in the housing, the heating element in fluid communication with the reservoir, the heating element configured to generate a vapor, a rechargeable battery configured to power at least the heating element (and any other potential power consuming element(s), such as electronic circuits), and a first memory having stored thereon computer readable instructions relating to the operating system.

In at least one example embodiment of the method, the executing the object code related to electronic vaping device functionality may include controlling vapor generation using the heating element and the reservoir.

In at least one example embodiment of the method, the electronic vaping device may include a charging interface configured to interface the rechargeable battery and an external power source, and the executing the object code may include controlling charging of the rechargeable battery using the external power source through the charging interface based on the object code.

In at least one example embodiment of the method, the electronic vaping device may include at least one input/output element, the at least one input/output element is at least one of a light-emitting diode, a button, a switch, and an airflow sensor, and executing the object code may include controlling the at least one input/output element based on the object code.

In at least one example embodiment of the method, the object code related to electronic vaping device functionality may include computer readable instructions for at least one of: electronic vaping device identification, powering on, powering off, power consumption, operating efficiency, heating element temperature control, reservoir pre-vapor formulation level detection, operating time, power reduction, power increase, battery charging control, user interface, communications, self-test, and e-vaping device monitoring.

In at least one example embodiment of the method, the electronic vaping device may include a reservoir interface configured to transfer data communications between the at least one processor and the reservoir, the reservoir may include a second memory configured to store reservoir profile information related to the pre-vapor formulation, and executing the operating system may include receiving the reservoir profile through the reservoir interface for storage in the first memory.

In at least one example embodiment of the method, the reservoir profile may include at least one of: pre-vapor formulation type, pre-vapor formulation identifier, vendor identifier, capacity, heating element configuration data, measurement capability, deliverable function amount, consumption capacity, and software capability.

In at least one example embodiment of the method, the electronic vaping device may include a host interface configured to transfer data communications between the at least one processor and an external computing device, and executing the operating system may include receiving data from the external computing device through the host interface for storage in the first memory.

In at least one example embodiment of the method, the data of the external computing device may include profile information associated with an owner of the electronic vaping device.

In at least one example embodiment of the method, the data received from the external computing device may include object code related to operating the electronic vaping device and the reservoir according to desired operational constraints.

In at least one example embodiment of the method, the housing may include a battery section and a reservoir section, a first memory and the at least one processor may be disposed in the battery section, and the first memory may have stored thereon computer readable instructions relating to the electronic vaping operating system.

In at least one example embodiment of the method, the housing may include a battery section and a reservoir section, a first memory and the at least one processor may be disposed in the reservoir section, and the first memory may have stored thereon computer readable instructions relating to the electronic vaping operating system.

In at least one example embodiment of the method, the object code may be based on source code written using an e-vaping programming language associated with the e-vaping operating system.

At least one example embodiment relates to a non-transitory computer readable media including computer readable instructions, which when executed by at least one processor, may configure the processor to execute computer readable instructions associated with an electronic vaping device (EVD) operating system, the EVD operating system including a real-time kernel configured to operate an electronic vaping device, and execute object code related to electronic vaping device functionality. The electronic vaping device may include a housing extending in a longitudinal direction, the housing including a mouth-end and a connection-end, a reservoir containing a pre-vapor formulation, the reservoir in the housing, a heating element in the housing, the heating element in fluid communication with the reservoir, the heating element configured to generate a vapor, and a rechargeable battery configured to power the heating element.

Further areas of applicability will become apparent from the description provided herein. The description and specific examples in this summary are intended for purposes of illustration only and are not intended to limit the scope of the present disclosure.

BRIEF DESCRIPTION OF THE DRAWINGS

The various features and advantages of the non-limiting embodiments herein may become more apparent upon review of the detailed description in conjunction with the accompanying drawings. The accompanying drawings are merely provided for illustrative purposes and should not be interpreted to limit the scope of the claims. The accompanying drawings are not to be considered as drawn to scale unless explicitly noted. For purposes of clarity, various dimensions of the drawings may have been exaggerated.

FIG. 8 is a table illustrating example functional API packages related to e-vaping device functionality according to at least one example embodiment.

Figure 1:
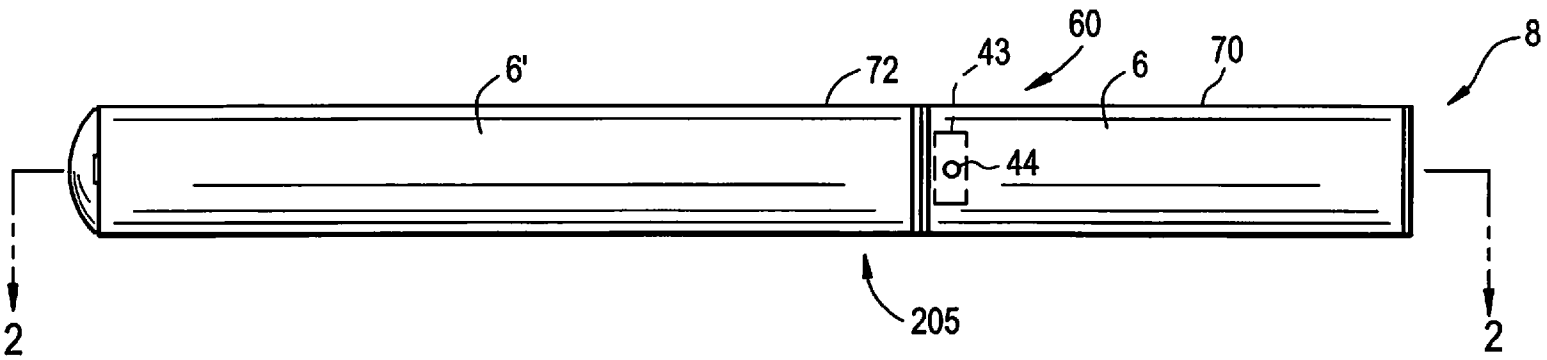
FIG. 1 is a side view of an e-vaping device according to at least one example embodiment.

It should be noted that these figures are intended to illustrate the general characteristics of methods and/or structure utilized in certain example embodiments and to supplement the written description provided below. These drawings are not, however, to scale and may not precisely reflect the precise structural or performance characteristics of any given embodiment, and should not be interpreted as defining or limiting the range of values or properties encompassed by example embodiments.

DETAILED DESCRIPTION

One or more example embodiments will be described in detail with reference to the accompanying drawings. Example embodiments, however, may be embodied in various different forms, and should not be construed as being limited to only the illustrated embodiments. Rather, the illustrated embodiments are provided as examples so that this disclosure will be thorough and complete, and will fully convey the concepts of this disclosure to those skilled in the art. Accordingly, known processes, elements, and techniques, may not be described with respect to some example embodiments. Unless otherwise noted, like reference characters denote like elements throughout the attached drawings and written description, and thus descriptions will not be repeated.

Although the terms "first," "second," "third," etc., may be used herein to describe various elements, regions, layers, and/or sections, these elements, regions, layers, and/or sections, should not be limited by these terms. These terms are only used to distinguish one element, region, layer, or section, from another region, layer, or section. Thus, a first element, region, layer, or section, discussed below may be termed a second element, region, layer, or section, without departing from the scope of this disclosure.

Spatially relative terms, such as "beneath," "below," "lower," "under," "above," "upper," and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below," "beneath," or "under," other elements or features would then be oriented "above" the other elements or features. Thus, the example terms "below" and "under" may encompass both an orientation of above and below. The device may be otherwise oriented (rotated 90 degrees or at other orientations) and the spatially relative descriptors used herein interpreted accordingly. In addition, when an element is referred to as being "between" two elements, the element may be the only element between the two elements, or one or more other intervening elements may be present.

As used herein, the singular forms "a," "an," and "the," are intended to include the plural forms as well, unless the context clearly indicates otherwise. It will be further understood that the terms "comprises" and/or "comprising," when used in this specification, specify the presence of stated features, integers, steps, operations, and/or elements, but do not preclude the presence or addition of one or more other features, integers, steps, operations, elements, and/or groups, thereof. As used herein, the term "and/or" includes any and all combinations of one or more of the associated listed items. Expressions such as "at least one of," when preceding a list of elements, modify the entire list of elements and do not modify the individual elements of the list. Also, the term "exemplary" is intended to refer to an example or illustration.

When an element is referred to as being "on," "connected to," "coupled to," or "adjacent to," another element, the element may be directly on, connected to, coupled to, or adjacent to, the other element, or one or more other intervening elements may be present. In contrast, when an element is referred to as being "directly on," "directly connected to," "directly coupled to," or "immediately adjacent to," another element there are no intervening elements present.

Unless otherwise defined, all terms (including technical and scientific terms) used herein have the same meaning as commonly understood by one of ordinary skill in the art to which example embodiments belong. Terms, such as those defined in commonly used dictionaries, should be interpreted as having a meaning that is consistent with their meaning in the context of the relevant art and/or this disclosure, and should not be interpreted in an idealized or overly formal sense unless expressly so defined herein.

Example embodiments may be described with reference to acts and symbolic representations of operations (e.g., in the form of flow charts, flow diagrams, data flow diagrams, structure diagrams, block diagrams, etc.) that may be implemented in conjunction with units and/or devices discussed in more detail below. Although discussed in a particularly manner, a function or operation specified in a specific block may be performed differently from the flow specified in a flowchart, flow diagram, etc. For example, functions or operations illustrated as being performed serially in two consecutive blocks may actually be performed simultaneously, or in some cases be performed in reverse order.

Units and/or devices according to one or more example embodiments may be implemented using hardware, software, and/or a combination thereof. For example, hardware devices may be implemented using processing circuitry such as, but not limited to, a processor, Central Processing Unit (CPU), a controller, an arithmetic logic unit (ALU), a digital signal processor, a microcomputer, a field programmable gate array (FPGA), a System-on-Chip (SoC), a programmable logic unit, a microprocessor, or any other device capable of responding to and executing instructions in a defined manner.

Software may include a computer program, program code, instructions, or some combination thereof, for independently or collectively instructing or configuring a hardware device to operate as desired. The computer program and/or program code may include program or computer-readable instructions, software elements, software modules, data files, data structures, and/or the like, capable of being implemented by one or more hardware devices, such as one or more of the hardware devices mentioned above. Examples of program code include both machine code produced by a compiler and higher level program code that is executed using an interpreter.

For example, when a hardware device is a computer processing device (e.g., a processor, Central Processing Unit (CPU), a controller, an arithmetic logic unit (ALU), a digital signal processor, a microcomputer, a microprocessor, etc.), the computer processing device may be configured to carry out program code by performing arithmetical, logical, and input/output operations, according to the program code. Once the program code is loaded into a computer processing device, the computer processing device may be programmed to perform the program code, thereby transforming the computer processing device into a special purpose computer processing device. In a more specific example, when the program code is loaded into a processor, the processor becomes programmed to perform the program code and operations corresponding thereto, thereby transforming the processor into a special purpose processor.

Software and/or data may be embodied permanently or temporarily in any type of machine, element, physical or virtual equipment, or computer storage medium or device, capable of providing instructions or data to, or being interpreted by, a hardware device. The software also may be distributed over network coupled computer systems so that the software is stored and executed in a distributed fashion. In particular, for example, software and data may be stored by one or more computer readable recording mediums, including the tangible or non-transitory computer-readable storage media discussed herein.

According to one or more example embodiments, computer processing devices may be described as including various functional units that perform various operations and/or functions to increase the clarity of the description. However, computer processing devices are not intended to be limited to these functional units. For example, in one or more example embodiments, the various operations and/or functions of the functional units may be performed by other ones of the functional units. Further, the computer processing devices may perform the operations and/or functions of the various functional units without sub-dividing the operations and/or functions of the computer processing units into these various functional units.

Units and/or devices according to one or more example embodiments may also include one or more storage devices. The one or more storage devices may be tangible or non-transitory computer-readable storage media, such as random access memory (RAM), read only memory (ROM), a permanent mass storage device (such as a disk drive), solid state (e.g., NAND flash) device, and/or any other like data storage mechanism capable of storing and recording data. The one or more storage devices may be configured to store computer programs, program code, instructions, or some combination thereof, for one or more operating systems and/or for implementing the example embodiments described herein. The computer programs, program code, instructions, or some combination thereof, may also be loaded from a separate computer readable storage medium into the one or more storage devices and/or one or more computer processing devices using a drive mechanism. Such separate computer readable storage medium may include a Universal Serial Bus (USB) flash drive, a memory stick, a Blu-ray/DVD/CD-ROM drive, a memory card, and/or other like computer readable storage media. The computer programs, program code, instructions, or some combination thereof, may be loaded into the one or more storage devices and/or the one or more computer processing devices from a remote data storage device via a network interface, rather than via a local computer readable storage medium. Additionally, the computer programs, program code, instructions, or some combination thereof, may be loaded into the one or more storage devices and/or the one or more processors from a remote computing system that is configured to transfer and/or distribute the computer programs, program code, instructions, or some combination thereof, over a network. The remote computing system may transfer and/or distribute the computer programs, program code, instructions, or some combination thereof, via a wired interface, an air interface, and/or any other like medium.

The one or more hardware devices, the one or more storage devices, and/or the computer programs, program code, instructions, or some combination thereof, may be specially designed and constructed for the purposes of the example embodiments, or they may be known devices that are altered and/or modified for the purposes of example embodiments.

A hardware device, such as a computer processing device, may run an operating system (OS) and one or more software applications that run on the OS. The computer processing device also may access, store, manipulate, process, and create data in response to execution of the software. For simplicity, one or more example embodiments may be exemplified as one computer processing device; however, one skilled in the art will appreciate that a hardware device may include multiple processing elements and multiple types of processing elements. For example, a hardware device may include multiple processors or a processor and a controller. In addition, other processing configurations are possible, such as parallel processors.

Although described with reference to specific examples and drawings, modifications, additions and substitutions of example embodiments may be variously made according to the description by those of ordinary skill in the art. For example, the described techniques may be performed in an order different with that of the methods described, and/or elements such as the described system, architecture, devices, circuit, and the like, may be connected or combined to be different from the above-described methods, or results may be appropriately achieved by other elements or equivalents.

FIG. 1 is a side view of an e-vaping device according to at least one example embodiment.

In at least one example embodiment, as shown in FIG. 1, an electronic vaping device (e-vaping device) 60 may include a replaceable cartridge (or first section) 70 and a reusable battery section (or second section) 72, which may be coupled together at a threaded connector 205. It should be appreciated that the connector 205 may be any type of connector, such as a snug-fit, detent, clamp, bayonet, and/or clasp. The first section 70 may include a housing 6 and the second section 72 may include a second housing 6'. The e-vaping device 60 includes a mouth-end insert 8. The end (i.e., tip) of the housing 6 where the mouth-end insert 8 is positioned may be referred to as the "mouth-end" or "proximal-end" of the e-vaping device 60. The opposite end of the e-vaping device 60 on the second housing 6' may be referred to as the "connection-end," "distal-end," "battery-end" or "front tip" of the e-vaping device 60.

In at least one example embodiment, the housing 6 and the second housing 6' may have a generally cylindrical cross-section. In other example embodiments, the housings 6, 6' may have a generally triangular cross-section along one or more of the first section 70 and the battery section 72.

Figure 2:
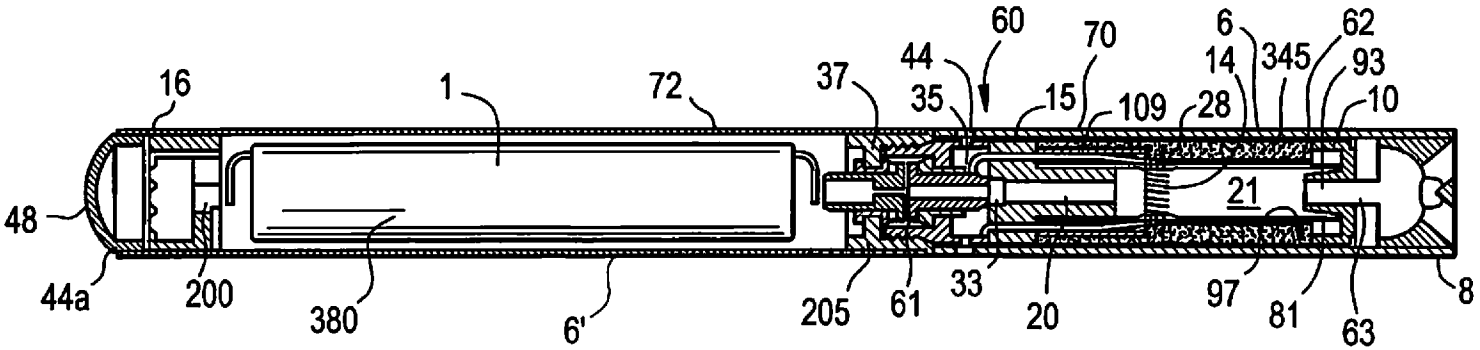
FIG. 2 is a cross-sectional view along line 2-2 of the e-vaping device of FIG. 1, according to at least one example embodiment.

FIG. 2 is a cross-sectional view along line 2-2 of the e-vaping device of FIG. 1.

In at least one example embodiment, as shown in FIG. 2, the first section 70 may include a reservoir 345 configured to contain a substance, such as a pre-vapor formulation, dry herbs, essential oils, etc., and a heater 14 that may vaporize the substance, which may be drawn from the reservoir 345 by a wick 28. The e-vaping device 60 may include the features set forth in U.S. Patent Application Publication No. 2013/0192623 to Tucker et al. filed Jan. 31, 2013, the entire contents of which is incorporated herein by reference thereto.

In at least one example embodiment, the pre-vapor formulation is a material or combination of materials that may be transformed into a vapor. For example, the pre-vapor formulation may be a liquid, solid and/or gel formulation including, but not limited to, water, beads, solvents, active ingredients, ethanol, plant extracts, natural or artificial flavors, and/or vapor formers such as glycerin and propylene glycol.

In at least one example embodiment, the first section 70 may include the housing 6 extending in a longitudinal direction and an inner tube (or chimney) 62 coaxially positioned within the housing 6.

At an upstream end portion of the inner tube 62, a nose portion 61 of a gasket (or seal) 15 may be fitted into the inner tube 62, while at the other end, an outer perimeter of the gasket 15 may provide a seal with an interior surface of the outer housing 6. The gasket 15 may also include a central, longitudinal air passage 20, which opens into an interior of the inner tube 62 that defines a central channel 21. A transverse channel 33 at a backside portion of the gasket 15 may intersect and communicate with the air passage 20 of the gasket 15. This transverse channel 33 assures communication between the air passage 20 and a space 35 defined between the gasket 15 and a cathode connector piece 37.

In at least one example embodiment, the cathode connector piece 37 may include a threaded section for effecting the connection between the first section 70 and the battery section 72. The cathode connector piece 37 may also be configured to provide an electrical connection between a data communication bus (not shown) between at least an operating system processing circuitry 200, a reservoir interface, and the reservoir 345. Additional elements may be connected to the communication bus as well, such as a host interface, charging interface, memory, I/O interface, etc. According to some example embodiments, the cathode connector piece 37 may function as the reservoir interface.

In at least one example embodiment, more than two air inlet ports 44 may be included in the housing 6. Alternatively, a single air inlet port 44 may be included in the outer housing 6. Such arrangement allows for placement of the air inlet ports 44 close to the connector 205 without occlusion by the presence of the cathode connector piece 37. This arrangement may also reinforce the area of air inlet ports 44 to facilitate precise drilling of the air inlet ports 44.

In at least one example embodiments, the air inlet ports 44 may be provided in the connector 205 instead of in the outer housing 6.

In at least one example embodiment, the at least one air inlet port 44 may be formed in the outer housing 6, adjacent the connector 205 to minimize the chance of an adult vaper's fingers occluding one of the ports and to control the resistance-to-draw (RTD) during vaping. In an example embodiment, the air inlet ports 44 may be machined into the housing 6 with precision tooling such that their diameters are closely controlled and replicated from one e-vaping device 60 to the next during manufacture.

In at least one example embodiment, a nose portion 93 of a downstream gasket 10 may be fitted into a downstream end portion 81 of the inner tube 62. An outer perimeter of the gasket 10 may provide a substantially tight seal with an interior surface 97 of the housing 6. The downstream gasket 10 may include a central channel 63 disposed between the inner passage 21 of the inner tube 62 and the interior of a mouth-end insert 8, which may transport the vapor from the inner passage 21 to the mouth-end insert 8.

During vaping, pre-vapor formulation, or the like, may be transferred from the reservoir 345 to the proximity of the heater 14 via capillary action of the wick 28. The wick 28 may include at least a first end portion and a second end portion, which may extend into opposite sides of the reservoir 345. The heater 14 may at least partially surround a central portion of the wick 28 such that when the heater 14 is activated, the pre-vapor formulation (or the like) in the central portion of the wick 28 may be vaporized by the heater 14 to form a vapor.

In at least one example embodiment, the heater 14 may include a wire coil which at least partially surrounds the wick 28. The wire may be a metal wire and/or the heater coil may extend fully or partially along the length of the wick 28. The heater coil may further extend fully or partially around the circumference of the wick 28. In some example embodiments, the heater coil 14 may or may not be in contact with the wick 28.

In at least one example embodiment, the heater 14 may heat pre-vapor formulation (or the like) in the wick 28 by thermal conduction. Alternatively, heat from the heater 14 may be conducted to the pre-vapor formulation (or the like) by means of a heat conductive element or the heater 14 may transfer heat to the incoming ambient air that is drawn through the e-vaping device 60 during vaping, which in turn heats the pre-vapor formulation (or the like) by convection.

It should be appreciated that, instead of using a wick 28, the heater 14 may include a porous material which incorporates a resistance heater formed of a material having an electrical resistance capable of generating heat quickly.

In at least one example embodiment, as shown in FIG. 2, the second section 72 of the e-vaping device 60 may include a puff sensor 16 responsive to air drawn into the second section 72 via an air inlet port 44*a* adjacent a free end or tip of the e-vaping device 60. The second section 72 may also include a power supply 1 and operating system processing circuitry 200 may include at least one processor, at least one memory, at least one interface, etc. The operating system processing circuitry 200 will be discussed in further detail in connection with FIG. 3. While the operating system processing circuitry is illustrated in FIG. 2 as residing in the second section 72, the example embodiments are not limited thereto, and the operating system processing circuitry 200 may be located in other areas of the e-vaping device housing, such as the first section 70.

Upon completing the connection between the first section 70 and the second section 72, the power supply 1 may be electrically connectable with the heater 14 of the first section 70 upon actuation of the puff sensor 16. Air is drawn primarily into the first section 70 through one or more air inlets 44, which may be located along the housing or at the connector 205.

The power supply 1 may include a battery 380 arranged in the e-vaping device 60. The power supply 1 may be a Lithium-ion battery or one of its variants, for example a Lithium-ion polymer battery. Alternatively, the power supply 1 may be a nickel-metal hydride battery, a nickel cadmium battery, a lithium-manganese battery, a lithium-cobalt battery or a fuel cell. The e-vaping device 60 may be usable by an adult vaper until the energy in the power supply 1 is depleted or in the case of lithium polymer battery, a minimum voltage cut-off level is achieved.

In at least one example embodiment, the power supply 1 may be rechargeable and may include circuitry configured to allow the battery to be chargeable by an external charging device. To recharge the e-vaping device 60, an USB charger or other suitable charger assembly may be used in connection with a charging interface (not shown). Additionally, a host interface (not shown) configured to communicate with an external computing device using wired and/or wireless communications may also be included in the housing of the power supply 1.

Furthermore, the puff sensor 16 may be configured to sense an air pressure drop and initiate application of voltage from the power supply 1 to the heater 14. The operating system processing circuitry 200 may also include an input/output (I/O) interface (not shown) configured to facilitate communications between the operating system processing circuitry 200 and the various input/output devices configured to provide various status indications to the adult vaper, such as a heater activation light 48 that is configured to glow when the heater 14 is activated. The heater activation light 48 may include a light-emitting diode (LED) and may be at an upstream end of the e-vaping device 60. Moreover, the heater activation light 48 may be arranged to be visible to an adult vaper during vaping. In addition, the heater activation light 48 may be utilized for e-vaping system diagnostics or to indicate that recharging is in progress. The heater activation light 48 may also be configured such that the adult vaper may activate and/or deactivate the heater activation light 48 for privacy. The heater activation light 48 may be on a tip end of the e-vaping device 60 or on a side of the housing 6.

In at least one example embodiment, the at least one air inlet 44*a* may be located adjacent the puff sensor 16, such that the puff sensor 16 may sense air flow indicative of an adult vaper taking a puff and activates the power supply 1 and the heater activation light 48 to indicate that the heater 14 is working. The heater activation light 48 may be located at and/or on the tip end of the e-vaping device. In other example embodiments, the heater activation light 48 may be located on a side portion of the housing 6.

In at least one example embodiment, the first section 70 may be replaceable. In other words, once the pre-vapor formulation, or other contents, of the cartridge is depleted, only the first section 70 may be replaced. An alternate arrangement may include an example embodiment where the entire e-vaping device 60 may be disposed once the reservoir 345 is depleted. Additionally, according to at least one example embodiment, the first section 70 may also configured so that the contents of the cartridge may be re-fillable.

While FIGS. 1 and 2 depict example embodiments of an e-vaping device, the e-vaping device is not limited thereto, and may include additional and/or alternative hardware configurations that may be suitable for the purposes demonstrated. For example, the e-vaping device may include a plurality of additional or alternative elements, such as additional heating elements, reservoirs, batteries, etc. Additionally, while FIGS. 1 and 2 depict the example embodiment of the e-vaping device as being embodied in two separate housing elements, additional example embodiments may be directed towards an e-vaping device arranged in a single housing, and/or in more than two housing elements.

Figure 3:
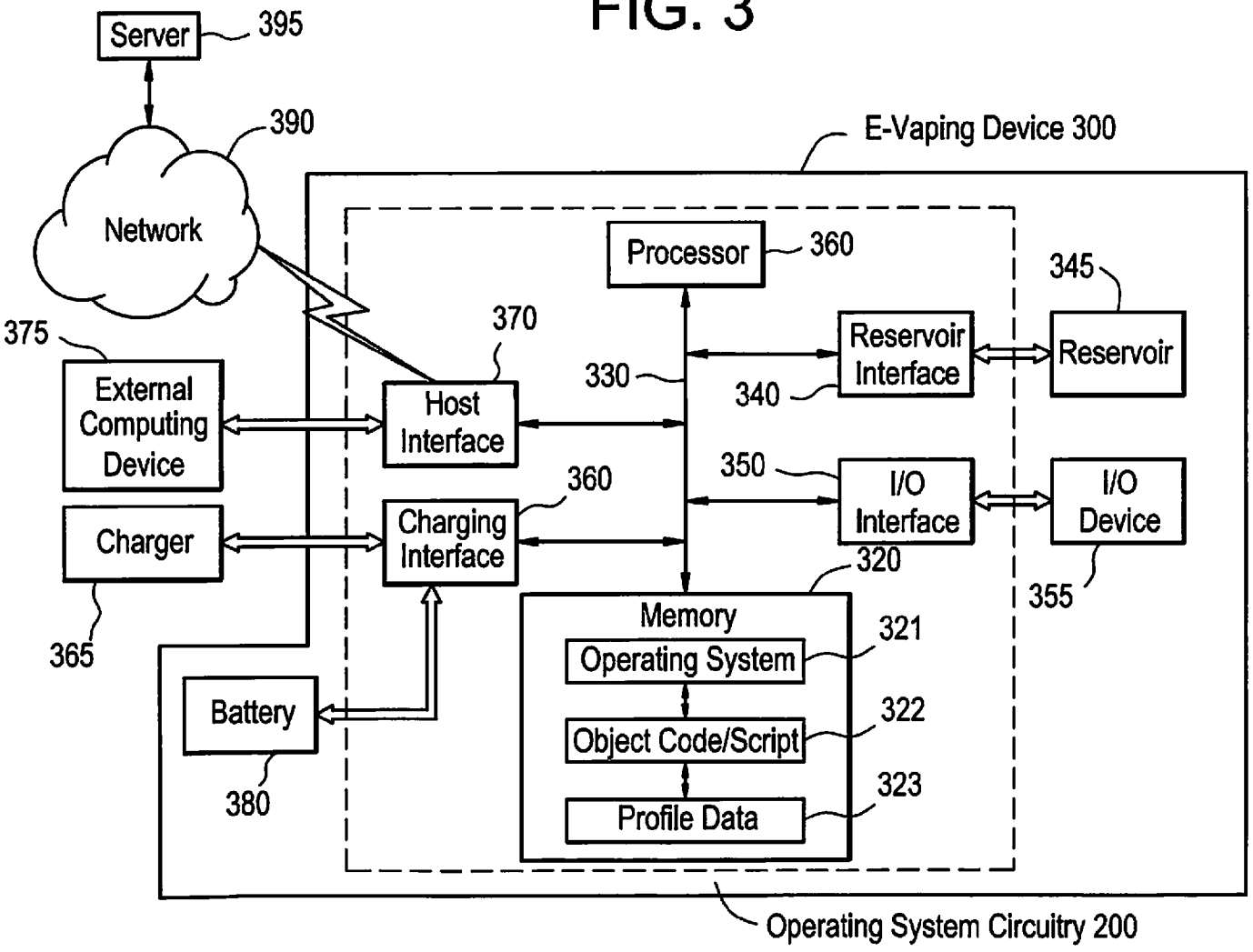
FIG. 3 is a block diagram illustrating various elements of an e-vaping system block diagram illustrating various elements of an e-vaping system including an e-vaping device including an e-vaping operating system circuitry according to at least one example embodiment.

FIG. 3 is a block diagram illustrating various elements of an e-vaping system including an e-vaping device including an e-vaping operating system circuitry according to at least one example embodiment.

In at least one example embodiment, as shown in FIG. 3, an e-vaping system may include an e-vaping device 300. The e-vaping device may include an operating system processing circuitry 200 that in turn may include a processor 310, a memory 320, a bus 330, a reservoir interface 340, an input/output (I/O) interface 350, a charging interface 360, a host interface 370, a battery 380, and the like. The memory 320 may include an e-vaping operating system 321, object code and/or script code related to the functionality of the e-vaping device 322, profile data 323, and the like.

In at least one example embodiment, the processor 310 may be at least one processor (and/or processor cores, distributed processors, networked processors, etc.), which may be configured to control one or more elements of the e-vaping device 300. The processor 310 is configured to execute processes by retrieving program code (e.g., computer readable instructions) and data from the memory 320 to process them, thereby executing control and functions of the entire e-vaping device 300. Once the program instructions are loaded into the processor 310, the processor 310 executes the program instructions, thereby transforming the processor 310 into a special purpose processor.

In at least one example embodiment, the memory 320 may be a non-transitory computer-readable storage medium and may include a random access memory (RAM), a read only memory (ROM), and/or a permanent mass storage device such as a disk drive, or a solid state drive. Stored in the memory 320 is program code (i.e., computer readable instructions) for the e-vaping operating system (OS) 321, object code and/or script code 322, and/or profile data 323, etc. Such software elements may be loaded from a non-transitory computer-readable storage medium independent of the memory 320, using a drive mechanism (not illustrated) connected to the e-vaping device 300 via a wired communication protocol, such as Ethernet, USB, FireWire, eSATA, ExpressCard, Thunderbolt, etc., protocols, using the host interface 370. In other example embodiments, software elements may be loaded onto the memory 320 through the host interface 370 via a wireless communication protocol, such as Wi-Fi, Bluetooth, Near-Field Communications (NFC), Infra-Red (IR) communications, RFID communications, 3G, 4G LTE, etc.

In at least one example embodiment, the e-vaping operating system 321 may be configured to perform instructions/tasks associated with providing real-time, multi-tasking execution of various software applications and/or scripts associated with the e-vaping device using a real-time kernel and task scheduler. The OS 321 may also be configured to provide memory management functionality, I/O management functionality (including interrupt handling), error handling functionality, synchronization functionality, and/or bootup functionality. The OS 321 may also include an interpreter for interpreting scripts written in a compatible e-vaping scripting language, as well as a compiler for compiling software applications written in a compatible e-vaping programming language.

In at least one example embodiment, the bus 330 may enable communication and data transmission to be performed between elements of the e-vaping device 300. The bus 330 may be implemented using a high-speed serial bus, a parallel bus, a storage area network (SAN), and/or any other appropriate communication technology.

In at least one example embodiment, the reservoir interface 340 may enable the processor 310 to communicate with and/or transfer data to/from a reservoir 345. Examples of data transferred between the processor 310 and the reservoir 345 may include profile data related to the pre-vapor formulation stored by the reservoir 345, profile data related to the reservoir 345, software updates stored on a memory included in the reservoir 345, etc. The reservoir interface 340 and the reservoir 345 will be discussed in greater detail in connection with FIG. 4.

In at least one example embodiment, the I/O interface 350 may enable the processor 310 to communicate with and/or control one or more I/O devices 355. For example, the I/O devices 355 may include digital inputs (e.g., digital switches, buttons, airflow sensors, etc.), digital outputs (e.g., LED indicator lights, display panels, speakers, etc.), analog inputs (e.g., battery voltage controllers, analog switches, analog airflow sensors, etc.), and analog outputs (e.g., vaporizer power output, voltage regulators, etc.). The I/O devices 355 may be included within and/or elements of the e-vaping device housing.

In at least one example embodiment, the charging interface 360 may enable the processor 310 to control a battery charger 365 and a battery 380. The battery 380 may be configured to store electrical power for use by various elements of the e-vaping device, including the processor 310, the memory 320, the heater 14, the reservoir 345, etc. The battery charger 365 may be an external charging device, or may be incorporated within the housing of the e-vaping device 300, and may be configured to transfer electrical power to the battery 380. According to some example embodiments, the operation of the battery 380 and the battery charger 365 via the charging interface 360 may be managed by the processor 310 that has been loaded with object code related to the battery functionality. For example, the processor 310 may have been loaded and specially configured to execute object code related to the rate of power transfer to the battery 380, times of days when the battery 380 may be charged, etc.

In at least one example embodiment, the host interface 370 may be a computer hardware element for connecting the e-vaping device to one or more computer networks 390 (e.g., the Internet, an Intranet, a Wide Area Network (WAN), a Local Area Network (LAN), a Personal Area Network (PAN), a Cellular Communication Network, a Data Network, etc.) and/or one or more external computing devices 375 (e.g., a personal computer (PC), a server, a database, a laptop computer, a smartphone, a tablet, a wearable smart device, an Internet-of-Things (IOT) device, a gaming console, a Personal Digital Assistant (PDA), etc.). The host interface 370 may connect the e-vaping device 300 to a computer network 390 and/or external computing device 375 through a wired and/or wireless connection. The host interface 370, computer network 390, and external computing device 375 will be discussed in further detail in connection with FIGS. 5, 6A and 6B.

While FIG. 3 depicts an example embodiment of an e-vaping system including an e-vaping device, the e-vaping system is not limited thereto, and may include additional and/or alternative architectures that may be suitable for the purposes demonstrated. For example, the e-vaping device 300 may include a plurality of additional or alternative elements, such as additional processing devices, interfaces, and memories.

Figure 4:
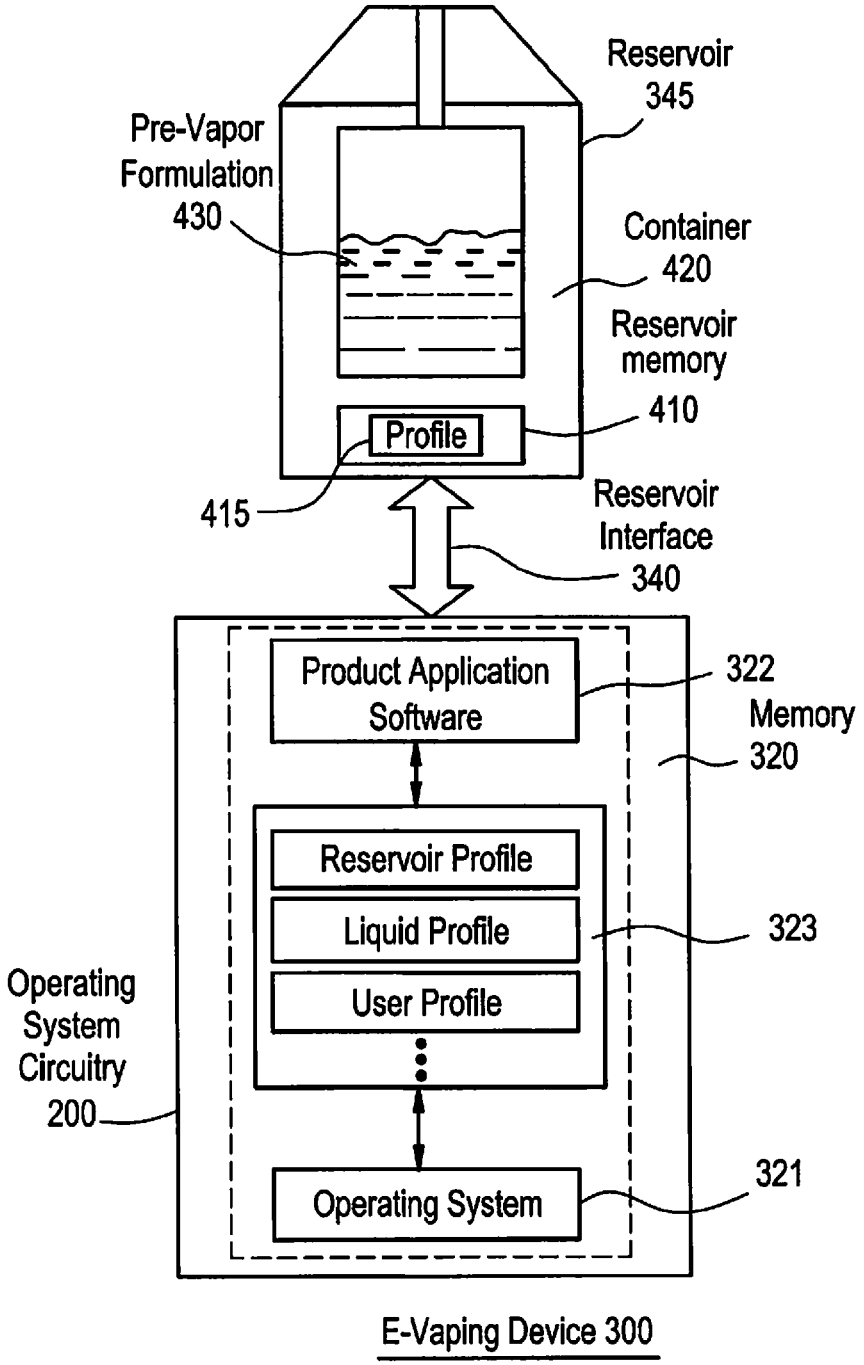
FIG. 4 is a block diagram illustrating various elements of a reservoir interface system according to at least one example embodiment.

FIG. 4 is a block diagram illustrating various elements of a reservoir interface system according to at least one example embodiment.

In at least one example embodiment, as shown in FIG. 4, a reservoir interface system for an e-vaping device, such as e-vaping device 300, may include a reservoir interface 340, a reservoir 345, an operating system circuitry 200, etc. The reservoir 345 may include a reservoir memory 410 configured to store data and/or program code, such as profile data related to the pre-vapor formulation stored by the reservoir 345, profile data related to the reservoir 345, software applications developed using an API specific to the e-vaping OS environment, scripting software developed using a scripting language specific to the e-vaping OS environment, software updates (i.e., patches, upgrades, firmware updates, driver updates, OS updates, etc.) for the software and hardware elements of the e-vaping device 300, etc. The reservoir memory 410 may be a non-volatile computer readable media, such as a ROM module, a programmable read only memory (PROM) module, an erasable programmable read only memory (EPROM) module, an electrically erasable programmable read only memory (EEPROM) module, a Flash EEPROM memory module, etc. Additionally, the reservoir memory 410 may also be a flash memory, such as a NOR flash memory, a NAND flash memory, a vertical NAND flash memory, etc., or a solid state memory, such as a secure digital (SD) card, a solid state memory, or the like.

In at least one example embodiment, the reservoir 345 may include a container 420 configured to store a pre-vapor formulation 430, or other substance (such as a dry herb, essential oil, etc.). The container 420 may be configured such that an adult vaper may re-fill the pre-vapor formulation 430 and/or fill the container with a different flavor or version of the pre-vapor formulation, or different substance. Additionally, when the container 420 is filled, whether at the time of manufacture stage or at a later time by an adult vaper or the like, the profile data of the reservoir memory 410 may be updated via the reservoir interface 340 to include data related to the contents of the container 420, such as the substance type (e.g., pre-vapor formulation, dry herb, essential oil, etc.), content name, vendor identification information, flavor name, flavor identification information, manufacturing date, re-fill date, ingredient information (e.g., propylene glycol (PG) %, Vapor Generation %, Water %, Nicotine %, etc.), properties information (e.g., viscosity, dielectric coefficient, desired operational parameter ranges—e.g., maximum heating temperature, minimum heating temperature, maximum vaporizer power, etc.), desired vapor generation temperature, desired Pulse Width Modulation (PWM) configuration, etc., and/or pre-vapor formulation related scripts. Additionally, the reservoir memory 410 may also be configured to store profile data related to the container 420, such as container type (e.g., cartridge, refillable tank, non-refillable tank, etc.), product identification information, vendor identification information, capacity, vaporizer information (e.g., vaporizer type, vaporizer resistance, number of coils, coil information for each coil—e.g., coil wire characteristics, coil wire length, etc., wick information, etc.), pre-vapor formulation level measurement capabilities, volume of pre-vapor formulation consumed per second of puff, electronics and software capabilities and version information, information regarding various desired operational constraints, such as information regarding safety constraints regarding the use of the pre-vapor formulation/e-vaping device, information regarding the regulatory constraints regarding the use of the pre-vapor formulation/e-vaping device, information regarding manufacturer recommended constraints regarding the use of the pre-vapor formulation/e-vaping device, container specific scripts, etc.

Additionally, according to some example embodiments, the reservoir memory 410 may be configured to store digital rights management (DRM) software that may indicate whether the reservoir 345 is properly licensed and/or compatible for use with the e-vaping device 300. When the reservoir 345 is connected to the operating system processing circuitry 200 via the reservoir interface 340, a processor, such as the processor 310 and/or a controller located within the reservoir 345 (not shown), may perform a verification based on at least the DRM software stored on the reservoir memory 410, and accordingly enable or disable the functionality of the reservoir 345 with the e-vaping device 300. If the DRM verification is successful, the processor 310 of the operating system processing circuitry 200 may download profile data and/or software from the reservoir memory 410 to the e-vaping device memory 320 via the reservoir interface 340. The processor 310 may also be configured to upload data, software commands, etc. to the reservoir 345 via the reservoir interface 340 as well. Such data uploads may include modifications to reservoir profile settings, such as desired operational settings stored on the reservoir memory 410, updates to the DRM software, information regarding the safe use of the pre-vapor formulation, information regarding the regulatory use of the pre-vapor formulation, etc.

In at least one example embodiment, the reservoir 345 may also include various sensors (not shown), including sensors configured to determine the amount of content stored in the container 420 (e.g., the volume of pre-vapor formulation 430, volume of dry herbs, volume of essential oils, etc.), or the like.

Figure 5:
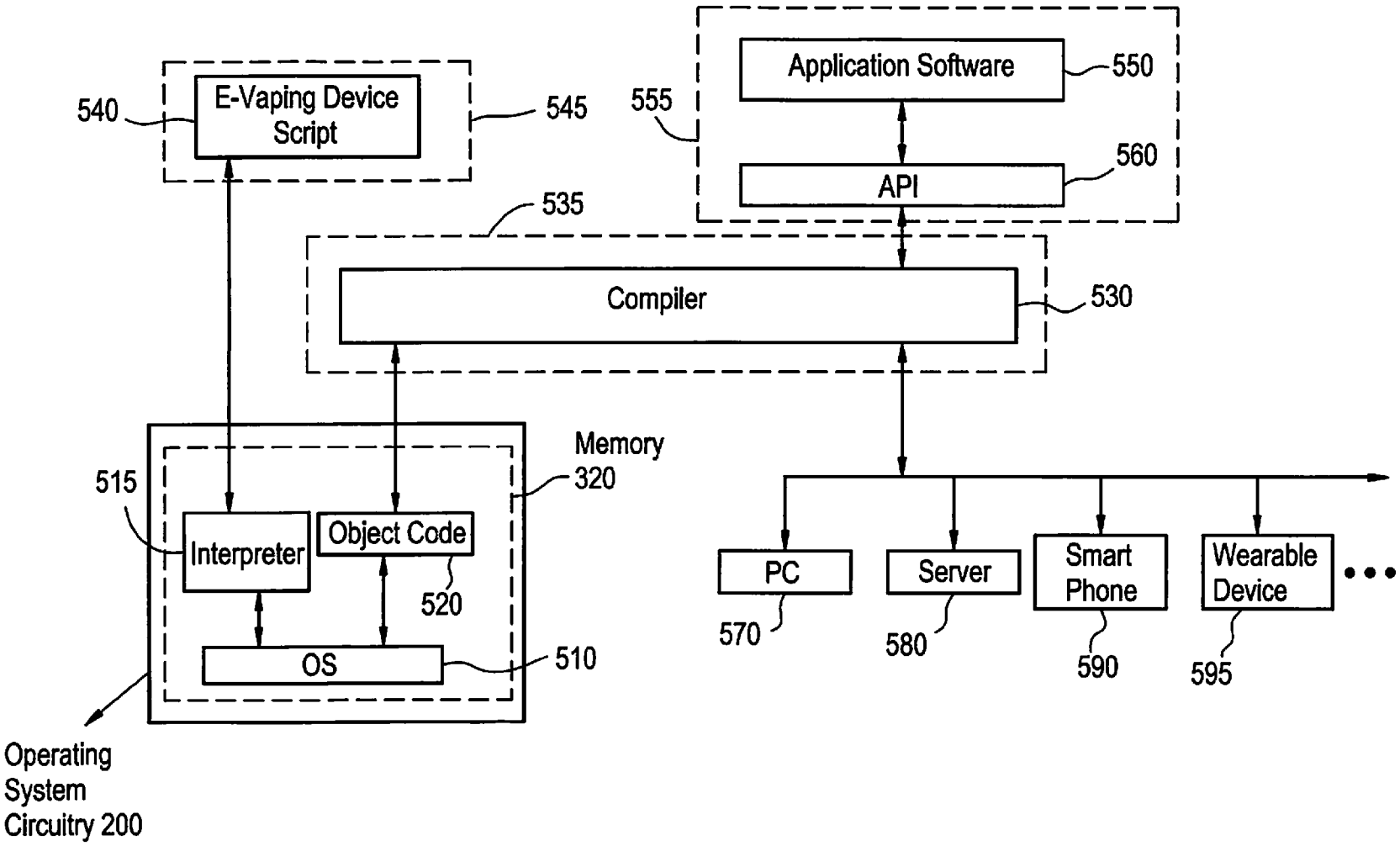
FIG. 5 is a block diagram illustrating elements of a software development environment system for developing applications and scripts for an e-vaping operating system and e-vaping device according to at least one example embodiment.

FIG. 5 is a block diagram illustrating elements of a software development environment system for developing applications and scripts for an e-vaping operating system and e-vaping device according to at least one example embodiment.

In at least one example embodiment, as illustrated in FIG. 5, a software development environment system may include at least one operating system processing circuitry 200 including memory 320, at least one compiler 530 executing on a development computing device 535, at least one e-vaping device script 540 stored on a script development computing device 545, at least one at least one application software 550 and at least one API 560 stored on an application development computing device 555, and/or at least one external computing device (e.g., PC 570, server 580, smartphone 590, wearable device 595, etc.). The memory 320 may store an e-vaping OS 510, a script interpreter 515, and object code 520.

According to at least one example embodiment, the e-vaping device script 540 may be developed on a script development computing device 545 (e.g., PC, laptop, server, smartphone, tablet, wearable smart device, Internet-of-Things (JOT) device, gaming console, PDA, etc.) using a high-level e-vaping specific script programming language (i.e., scripting language), such as the e-Vapor Generation Language (eVGL), that is associated with the e-vaping operating system. The scripting language may provide e-vaping specific functional packages, libraries, bindings, and/or script extensions that provide software implementations for basic functions of one or more e-vaping devices, such as software controls for the operation of I/O devices, hardware elements of the e-vaping device such as the heater, reservoir, battery, device drivers, etc. Additionally, the e-vaping scripting language may include software instructions that allow for the control/execution of e-vaping device event handlers, such as the engagement/disengagement of a power switch, LED indicator, a heater, a timer, etc. For example, a programmer may develop a script using the scripting language to formulate a heater power delivery scheme where the heater is programmed to generate vapor for a desired period of time (e.g., 30 seconds) at a desired power level (e.g., 5 watts), and a LED indicator is powered for the desired period of time. The script 540, when executed by the processor of the operating system processing circuitry 200 through the OS 510, may also access desired data (e.g., profile data) and/or memory space stored on the memory of the operating system processing circuitry 200 and/or the reservoir of the e-vaping device. However, according to at least one example embodiment, the script 540 may have be limited to only accessing certain areas of memory and/or data based on the privileges granted to the script 540 as determined and monitored by the OS 510. For example, certain areas of memory may be designated protected areas of memory that is only accessible by the OS 510, and unavailable to the script 540. Additionally, the scripting language may be used to provide programmatic assistance with the safe usage of the e-vaping device, or to comply with regulatory rules and guidelines.

The source code of the e-vaping device script 540 may be loaded onto the memory 320 of the operating system processing circuitry 200 and may then be interpreted by an interpreter 515 associated with the scripting language. The interpreter 515 may be an element of the e-vaping operating system 510. The interpreter 515 may be configured to load instructions from the source code of the script 540 and "interpret" (i.e., convert) the source code into computer readable (i.e., machine readable) code. The interpreted code is then executed by the processor of the operating system processing circuitry 200 via the OS 510.

In at least one example embodiment, the application software 550 may be may be developed on an application development computing device 555 (e.g., PC, laptop, server, smartphone, tablet, wearable smart device, Internet-of-Things (IOT) device, gaming console, PDA, etc.) using a high-level compile-able application programming language specific to an e-vaping operating environment that may have similar syntax as high-level programming languages such as BASIC, C, C++, JAVA, etc. Additionally, according to various example embodiments, the application programming language may have a "natural language" programming structure and/or programming user interface, that is configured to allow for programming in terms of natural language (e.g., English, etc.) sentences and/or phrases instead of more traditional programming languages, to facilitate the development of application software by scientists, technicians, home-enthusiasts, etc., in addition to computer programmers. The application programming language may also include one or more Application Programming Interfaces (APIs) 560 that may include functional packages, libraries, classes, modules, or the like, that provide software implementations for basic functions of one or more e-vaping devices, such as software controls for the operation of I/O devices, hardware elements of the e-vaping device such as the heater, reservoir, battery, device drivers, etc. Additionally, the application programming language and/or API 560 may include software instructions that allow for the control/execution of e-vaping device event handlers, such as the engagement/disengagement of a power switch, LED indicator, a heater, a timer, etc. The application programming language and/or API 560 may also further include instructions that may provide additional functionality (and/or modify and delete functionality) to the OS 510 of the e-vaping device, as well as the hardware elements of the e-vaping device 300. For example, a programmer may develop an application using the application programming language and/or API 560 to configure the host interface of the e-vaping device to communicate with external computing devices 570 to 595 using a new communications protocol. The application programming language and/or API 560 may also include tools and software packages related to graphical user interfaces (GUIs) for use with applications developed for use with external computing devices (e.g., external computing devices 570 to 595). The at least one API 560 may be configured to be compatible with a plurality of e-vaping devices, product lines, e-vaping device elements (e.g., reservoirs, heaters, interfaces, etc.), e-vaping operating system versions, external computing device operating systems types and versions (e.g., Windows, Linux, Unix, MacOS, Android, iOS, etc.), etc.

According to at least one example embodiment, the source code of the application software 550 may be compiled using a compiler 530 into object code 520. The compiler 530 may execute on a development computing device 535 (e.g., PC, laptop, server, smartphone, tablet, wearable smart device, Internet-of-Things (IOT) device, gaming console, PDA, etc.). The object code 520 may be in a computer readable (e.g., machine readable) language/format that is compatible with the run-time environment that it will be loaded onto. For example, the compiled object code 520 may be loaded onto the e-vaping device 300, and may also be loaded onto external computing devices, such as PC 570, server 580, smartphone 590, wearable device 595, etc. During compile-time, the programmer may indicate which run-time environment that the object code will be executed and/or processed on, including indicating the processor type (e.g., x86-type, ARM-type, RISC-type, 32-bit, 64-bit, 128-bit, etc.) and operating system type of the run-time environment, and the compiler 530 may be configured to compile the application software 550 source code into object code 520 compatible with the desired run-time environment. Additionally, the e-vaping operating system 510 may also include a compiler element configured to compile the application software source 550 code into object code 520.

According to some example embodiments, the compiler 530 may be a just-in-time (JIT) compiler, instead of a static compiler, that is configured to perform the compilation of the application software 550 source code into object code 520 during execution of the application software on the e-vaping device 300. The JIT compiler may be configured to continuously compile sections of the source code (e.g., compile the source code on a per-file, per-function, and/or per-line basis) when the section of the source code is about to be executed. Additionally, the JIT compiler may be configured to further optimize the compiled object code to reflect the target processor(s) and the e-vaping operating system, as well as to cache compiled object code in memory during the execution of the object code by the e-vaping operating system 510. The JIT compiler may be a virtual machine operated by the e-vaping operating system 510. According to various example embodiments, the object code may include computer readable instructions written in a low-level programming language, such as machine language, etc., associated with the instruction set architecture (ISA) of the specific processor(s) type of the operating system processing circuitry 200.

Additionally, according to some example embodiments, the source code may be compiled into portable code ("p-code") and/or other binary code forms instead of machine code to be executed by the interpreter and/or JIT compiler.

The compiled object code 520 (e.g., machine code) of the application software 550 may be loaded and/or embedded at the time of manufacture onto the memory of the e-vaping device 300, the reservoir of the e-vaping device, etc., and when executed by the processor of the e-vaping device through the OS 510, may access desired data (e.g., profile data) and/or memory space stored on the memory of the e-vaping device 300 and/or the reservoir of the e-vaping device. However, according to at least one example embodiment, the object code 520 may have be limited to only accessing certain areas of memory and/or data based on the privileges granted to the script 540 as determined and monitored by the OS 510. For example, certain areas of memory may be designated protected areas of memory that is only accessible by the OS 510, and unavailable to the object code 520. Additionally, the application programming language may be used to provide programmatic assistance with the safe usage of the e-vaping device, or to comply with regulatory rules and guidelines. The object code 520 may also be loaded onto at least one external computing device, such as PC 570, server 580, smartphone 590, and/or wearable device 595, etc., in order to provide additional related and/or enhanced functionality to the adult vaper. For example, a programmer may develop a smartphone application (i.e., app) that may be configured to analyze, monitor, and/or track the adult vaper's e-vaping device usage by transmitting data through the e-vaping device's host interface. As another example, an app may be configured to provide the adult vaper with a graphical user interface that allows the adult vaper to illustrate the status and identification information of the various elements of the e-vaping device 300 (e.g., battery level, reservoir content level, reservoir content type, etc.), or to input and/or otherwise indicate the adult vaper's personal vaping preferences (e.g., desired and/or preferred vaping power level, puff duration, total time spent vaping, etc.). As another example, a software application may store vaper identification verification information, using biometric information (e.g., fingerprint data, image data, voice data, etc.) collected by a PC, laptop, smartphone, wearable device, etc., in order to perform age verification of the adult vaper and ensure that the e-vaping device 300 is not operated by a person who does not meet legal and/or regulatory standards. As another example, a server application may be configured to communicate with the e-vaping device 300 through the host interface in order to determine the e-vaping preferences or usage statistics of the adult vaper, and then to provide the adult vaper with promotional offers and marketing materials tailored to the adult vaper's preferences. As another example, a smoking control/cessation embeddable software application may be developed that may be configured to monitor the vaping habits of the adult vaper and may apply limits to the usage of the e-vaping device based on desired vaping limits in order to assist the adult vaper in reducing and/or eliminating their smoking/vaping habit.

In addition to the API 560, the application software 550 may also be compatible with and/or used in conjunction with application development tools associated with the e-vaping programming language. The application development tools may include a software development kit (SDK) to assist programmers with developing applications with the e-vaping programming language. The SDK may include sample source code, detailed API information, etc., to further assist the programmer. Additionally, the programmer may also be provided with an integrated development environment (IDE) for use with the e-vaping programming language. The IDE may include tools and utilities for the programming compatible with and/or used in conjunction with the e-vaping programming language, such as a e-vaping programming language specific source code editor, build automation tools, and a debugger. The IDE may also include the compiler 530, as well as a modified version of the interpreter 515 that is configured to execute the script code 540 on a development/test environment that may not be the e-vaping device (e.g., a PC, server, etc., that a programmer may use to develop the application software). The IDE may also be configured to provide a graphical user interface for the API 560 and/or SDK.

According to various example embodiments, the development computing device 535, script development computing device 545, and/or the application development computing device 555 may be combined into a single computing device, or may be rearranged so that the compiler 530, e-vaping device script 540, application software 550, and/or API 560, are executed on two or more computing devices. Additionally, one or more of the compiler 530, e-vaping device script 540, application software 550, API 560, IDE, and/or SDK may also be stored on, and executed by, the external computing devices 570 to 595.

Figure 6A:
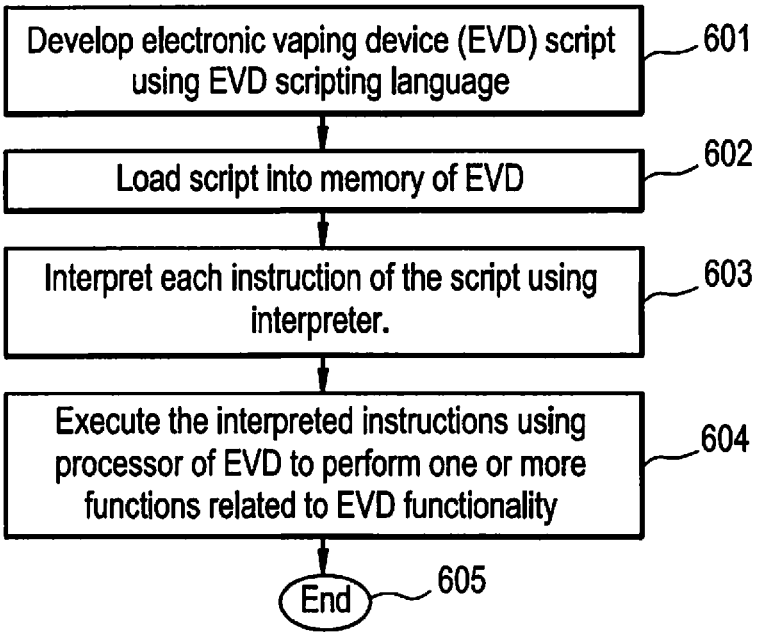
FIG. 6A is a flowchart illustrating a method for developing an electronic vaping device (EVD) script using an EVD Application Programming Interface (API) according to at least one example embodiment.

FIG. 6A is a flowchart illustrating a method for developing an electronic vaping device (EVD) script using an EVD Application Programming Interface (API) according to at least one example embodiment.

At operation 601, an e-vaping device (EVD) script may be developed using an e-vaping specific script programming language, such as the e-Vapor Generation Language (eVGL) scripting language, as well as a e-vaping SDK and/or e-vaping IDE.

At operation 602, the EVD script may be loaded from an external computing device, such as a computer that the EVD script was developed on, onto the memory of the e-vaping device through the host interface of the e-vaping device.

At operation 603, one or more of the EVD script source code is interpreted by an interpreter into computer readable instructions for execution by the processor of the e-vaping device. The EVD script source code is interpreted on a line by line basis (i.e., instruction by instruction basis), and if an error in the script code is detected, the interpretation of the script code is halted and an error code/message is generated and/or logged.

At operation 604, the interpreted script code is executed by the processor of the e-vaping device to perform one or more functions related to the e-vaping device's functionality. If an operational error is detected, the execution of the interpreted script code may be halted and an error code/message may be generated and/or logged.

Figure 6B:
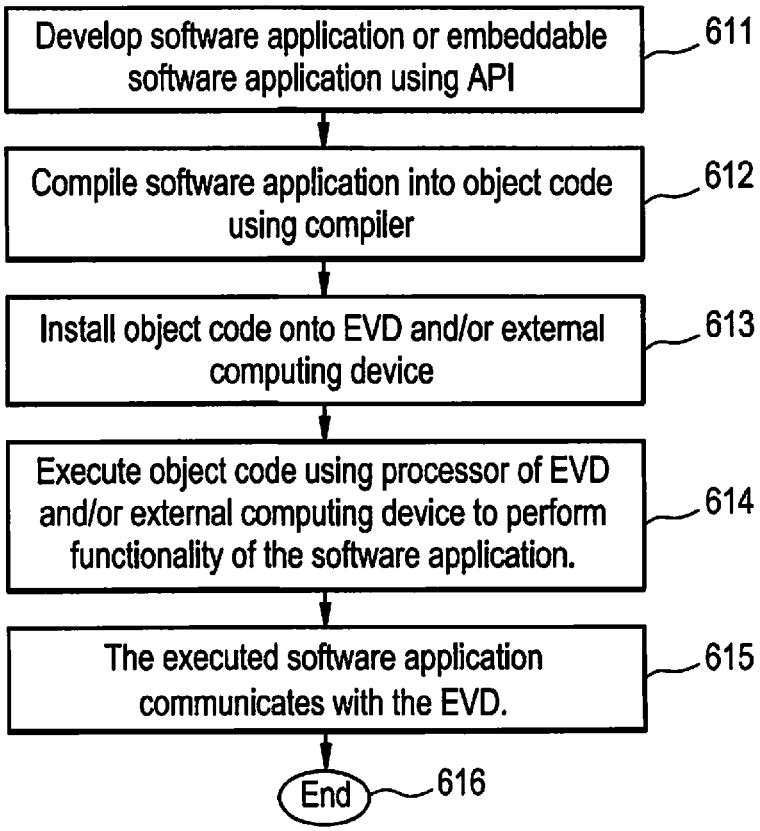
FIG. 6B is a flowchart illustrating a method for developing software applications and/or embeddable software applications using an EVD API for use with external computing device and/or an e-vaping device according to at least one example embodiment.

FIG. 6B is a flowchart illustrating a method for developing software applications, and/or embeddable software applications, using an EVD API for use with an external computing device and/or e-vaping device according to at least one example embodiment.

At operation 611, an e-vaping device (EVD) application software may be developed using an e-vaping specific application programming language, as well as a e-vaping SDK and/or e-vaping IDE.

At operation 612, the application software source code may be compiled using a compiler into object code (e.g., computer readable instructions) for execution by the processor of the e-vaping device and/or external computing device. The entire application source code is compiled by the compiler at one time, and if an error in the application code is detected, the compilation of the application code is halted and an error code/message is generated and/or logged. According to at least one example embodiment, the compiler may be executed on an external computing device, such as a development and/or test computer, or may be executed on the e-vaping device. In this example embodiment, the application software source code is loaded onto the e-vaping device's memory prior to the compiling of the source code by the compiler executing on the e-vaping device.

At operation 613, the compiled object code is loaded and/or installed onto the e-vaping device and/or external computing device. The loading of the compiled object code may occur at the time that the e-vaping device was manufactured (i.e., the object code was "embedded" onto the e-vaping device).

At operation 614, the object code is executed by the processor of the e-vaping device and/or external computing device to perform one or more functions related to the e-vaping device's functionality. If an operational error is detected, the execution of the object code may be halted and an error code/message may be generated and/or logged.

At operation 615, when the object code is executed by an external computing device, the object code may communicate with the e-vaping device to provide further additional functionality to the adult vaper.

Figure 7:
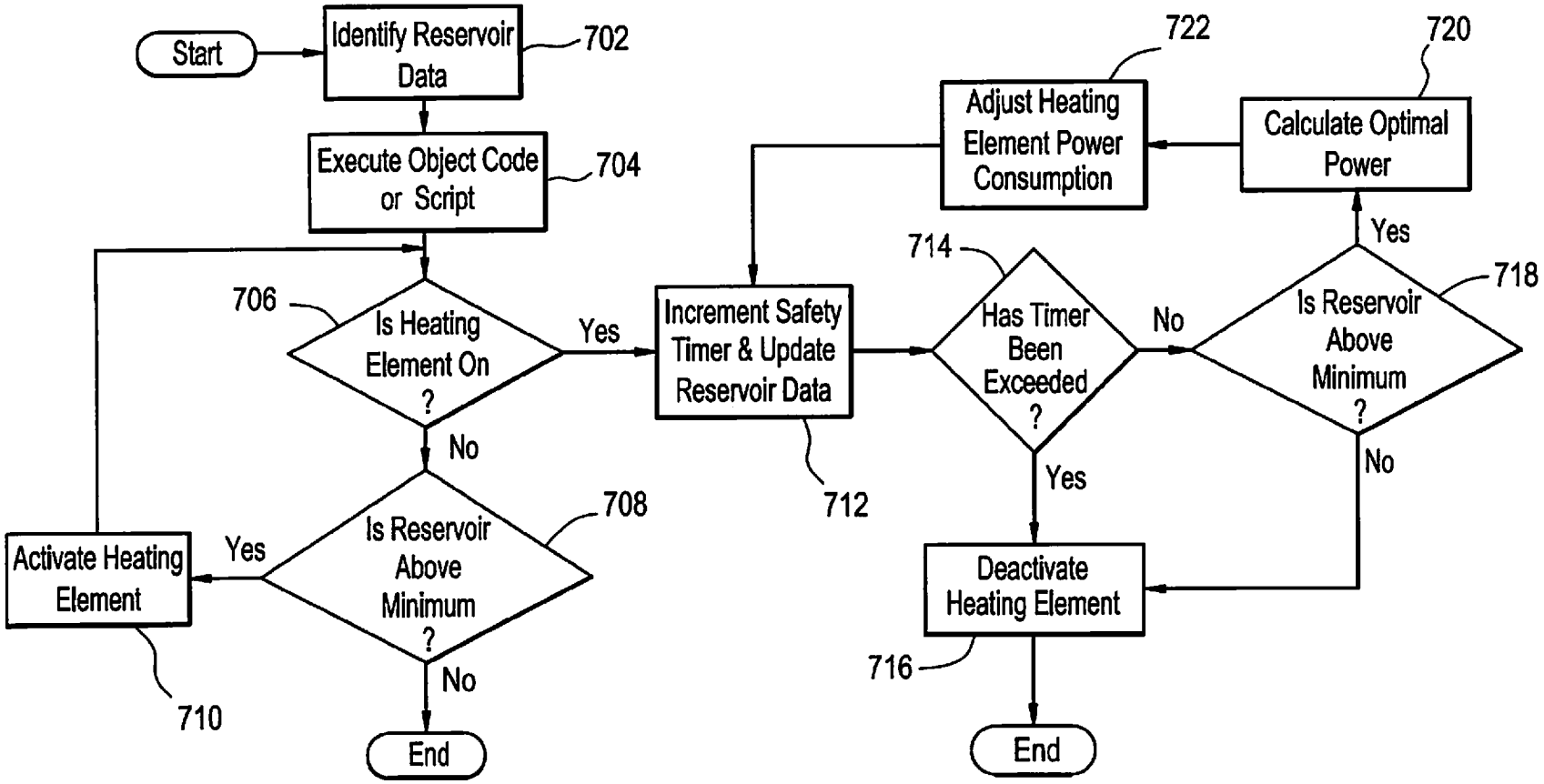
FIG. 7 is a flow diagram illustrating a method for operating an e-vaping device using a program script programmed in a scripting language compatible with an e-vaping operating system in accordance with at least one example embodiment.

FIG. 7 is a flow diagram illustrating a method for operating an e-vaping device using a program script programmed in a specialized programming language of an e-vaping operating system in accordance with at least one example embodiment.

In at least one example, as shown in FIG. 7, an e-vaping script code and/or an embedded application software code may be configured to manage the operation of a heater 14 based on a timer and the amount of deliverable content 430 remaining in a reservoir 345. Operations illustrated in FIG. 7 may be performed using the e-vaping operating system 510 executed on the processor 310 of the e-vaping device 300.

An example embodiment of pseudo-code implementing the operations illustrated in FIG. 7 is depicted herein.

```
ON EVENT EVT_PUFF_ON
  IF VAP STATE= OFF
    IF PLD_STATE_OF_LIQUID> 5
```

-continued

```
        VAP_POWER_ON( )
        TMR_ON(1800)
      ELSE
        IF PLD_STATE_OF_LIQUID< 5
            VAP_POWER_OFF( )
            OFF( )
        ELSE
          INTwatts = CIEL(PLD_STATE_OF_LIQUID / 20)
          VAP_SET_WATTS(watts)
        ENDIF
      ENDIF
    ENDIF
END EVENT
ON EVENT EVT_TMR_EXPR
  VAP_POWER_OFF( )
END EVENT
```

As shown above with regards to the pseudo-code example embodiment, the e-vaping programming language and/or e-vaping scripting language associated with the e-vaping operating system 510 of the e-vaping device 300 may include a number of functional packages that may include a variety of native libraries, classes, functions, operators, variable types, etc. for use in controlling operation of the elements of the e-vaping device 300. However, the e-vaping programming language and/or the e-vaping scripting language are not limited to the programming operators, variable types, syntax, etc., shown above, and may take alternate forms.

In operation 702, reservoir data may be identified by the processor 310, via a reservoir interface between the processor 310 and the reservoir 345. The processor 310 may store the profile data 415 in the e-vaping device's memory 320. The reservoir data may include data associated with the deliverable content 430 and the deliverable function, such as a variable PLD_STATE_OF_LIQUID, which may be a percentage representation of the amount of deliverable function 430 remaining in the reservoir 345. In operation 704, the processor 310 may execute the script and/or software application stored in the memory 320 containing the above program code, which may include interpreting the code and/or compiling the program code into object code and execution thereof. For example, operation 704 may be initiated upon activation of an EVT_PUFF_ON event handler, through the engagement of a button or other I/O device on the e-vaping device.

In operation 706, the processor 310 may determine if the heater 14 is currently activated. If the heater 14 is not activated (e.g., IF VAP_STATE==OFF), then, in operation 708, the processor 310 may determine if the deliverable function (e.g., pre-vapor formulation) remaining in the reservoir 345 is above a minimum amount, for example 5%. If the deliverable function exceeds the minimum amount (e.g., IF PLD_STATE_OF_LIQUID>5), then, in operation 710, the processor 310 may instruct the heater 14 to activate (e.g., VAP_POWER_ON( )). In the above example, activation of the heater 14 may also include activating a timer (e.g., TMR_ON(1800)) for three minutes, to limit the use of the heater 14. If the deliverable function is less than the minimum amount, then the process 700 may be ended, as there may be insufficient deliverable function to operate.

Once the heater 14 is determined to be activated during the process 700 (e.g., the initial ELSE), then, in operation 712, the processor 310 may increment the safety timer and update the reservoir data received from the reservoir 345 regarding the amount of deliverable function remaining in the container 420. In some instances, this may be performed automatically by the processor 310, such as based on operating code of the operating system 510, via a concurrently executed program code, etc. In other instances, the program code may include an additional command to update the reservoir profile and increment the timer.

In operation 714, the processor 310 may determine if the timer limit has been exceeded (e.g., activation of the EVT_TMR_EXPR event handler). If the time limit has been exceeded, then, in operation 716, the processor 310 may provide an instruction to the heater 14 that the heater 14 be deactivated (e.g., VAP_POWER_OFF( )). If the time limit has not been exceeded, then the process 700 may proceed to operation 718, where the processor 310 may determine if the deliverable function is still above the minimum (e.g., IF PLD_STATE_OF_LIQUID>5). If the amount is no longer above the minimum, then the heater 14 may be deactivated (e.g., VAP_POWER_OFF( )) as illustrated in operation 716.

If the amount of deliverable function is above the minimum, then, in operation 720, the processor 310 may calculate the optimal power amount of operation of the heater 14 based on the amount of deliverable function (e.g., INT watts=CIEL(PLD_STATE_OF_LIQUID/20)). In operation 722, the power consumption of the heater 14 may be adjusted by the processor 310 based on the newly calculated power amount (e.g., VAP_SET_WATTS(watts)). The process 700 may then return to operation 712, where the timer is incremented, deliverable function amount updated, and the timer and function amount evaluated again for continued operation until the timer is exceeded or the deliverable function runs out.

It will be apparent to persons having skill in the relevant art that the program code discussed above and execution thereof illustrated in FIG. 7 is provided as an illustration of an example embodiment only, and that program code compiled/interpreted and executed by the e-vaping operating system of e-vaping device discussed herein may include a plurality of additional and/or alternative functions, variables, event handlers, etc. By use of these functions and other aspects of a e-vaping programming language and/or e-vaping scripting language associated with the e-vaping operating system, applications and/or scripts may be designed and implemented in a plurality of e-vaping devices by multiple entities using the standardized programming language for execution by any number of processors for the control of operation of any number of elements, such as a plurality of different heaters, reservoirs, content, etc. In addition, because the variables used therein are standardized due to the application programming language and/or scripting language of the operating system, various elements of an e-vaping device that uses the e-vaping operating system may be interchangeable with elements that were previously existing at the time of manufacture of the e-vaping device and/or newly developed. Additionally, for elements and e-vaping devices that were not originally designed for use with the e-vaping operating system, device drivers and/or API packages may be developed that allow the previously incompatible elements and e-vaping devices to be used with the e-vaping operating system.

As a result, e-vaping devices developed and operated using the example embodiments discussed herein may improve over traditional e-vaping devices in the ability to be easily modified to accommodate different elements, provide different operations, and suit adult vaper and manufacturer preferences without the need for manufacturing new ASICs or microcontrollers, replacement of key elements of the e-vaping device, and/or development of customized software specific to a single ASIC and/or microcontroller.

FIG. 8 is a table illustrating example functional API packages related to e-vaping device functionality according to at least one example embodiment.

In at least one example embodiment, a programming language developed for use with an e-vaping operating system 510 of the e-vaping device 300 may include a plurality of functional packages related to the functions and operations of the e-vaping device 300. Each functional package may provide libraries, classes, functions, modules, primitive types, operators, etc., native to the one or more elements and operations of the e-vaping operating system 510 and e-vaping device 300. For instance, the programming language may include a functional package for vapor generation, light-emitting diode operation, switch and button operation, timer processing, reservoir profiles (e.g., cartridge, tank, liquid, etc., profiles), e-vaping device operation logging and statistics, event handling, task scheduling, host communications, batteries and charging, script processing, reservoir-related functions, console (e.g., text and/or user interface) input and output, I/O configuration (e.g., sensors, buttons, timers, etc.), etc.

In some example embodiments, the functional packages may be accessed via one or more APIs. The APIs may include code libraries, such as object-oriented class libraries, that may include functions, classes, operators, etc. associated with the functional packages suitable for operation of the e-vaping device 300, reservoir 345, I/O devices 355, chargers 365, external computing devices 375, batteries 380, etc. For example, the functional package for vapor generation may include functions for blinking of light-emitting diodes, the control of power being provided to the heater 14, turning on and off the heater 14; the functional package for LED control may include functions for turning on or off light-emitting diodes, controlling the blinking of light-emitting diodes, or setting the light color; the functional package for communications may include functions for connecting to an external computing device and/or server and transmitting and/or receiving data from the external computing device and/or server; the functional package for battery control may include functions for reading the battery's power and controlling the current for charging the battery; the functional package for programming language control may include the functions to compile and execute the programming language scripts, provide user interface functionality, provide native self-test functionality (e.g., the operating system may be configured to test the operating status of various elements of the e-vaping device, etc.), and e-vaping device monitoring (e.g., e-vaping usage data collection, desired operational constraint monitoring, etc.), etc.

Various example embodiments of the functional packages may be related to specific e-vaping devices, reservoirs, external computing devices, hardware elements, etc., and/or may be device-agnostic and compatible with more than one e-vaping device, reservoir, external computing device, hardware element, etc. Additionally, the functional packages of the e-vaping programming language are not limited hereto, and may include further functional packages developed for new e-vaping devices, reservoirs, external computing devices, hardware elements, etc. Various functional packages may also provide device and/or element driver support for the e-vaping OS and/or the OS executing on the external computing devices. These device driver functional packages may be configured to provide a software interface to hardware devices (e.g., the e-vaping device, etc.), or hardware elements (e.g., the heater, the reservoir, the processor, the I/O devices, the battery, etc.), that enables the OS, scripts, and/or software applications to access the hardware functions via software commands included in the driver, rather than directly invoking commands on the hardware directly through electrical signaling (i.e., using electrical pins).

The foregoing description has been provided for purposes of illustration and description. It is not intended to be exhaustive or to limit the disclosure. Individual elements or features of a particular example embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. An electronic vaping device, comprising:

a housing extending in a longitudinal direction, the housing including a mouth-end and a connection-end;

a reservoir containing a pre-vapor formulation, the reservoir in the housing, the reservoir including reservoir memory configured to store digital rights management (DRM) software and reservoir profile information related to the pre-vapor formulation;

a heating element in the housing, the heating element in fluid communication with the reservoir, the heating element configured to generate a vapor;

a rechargeable battery configured to power at least the heating element;

a first memory having stored thereon computer readable instructions relating to an electronic vaping operating system; and at least one processor configured to, execute the electronic vaping operating system, the electronic vaping operating system including a real-time kernel configured to operate the electronic vaping device, and execute object code related to electronic vaping device functionality, the object code compiled using an electronic vaping compiler corresponding to the electronic vaping operating system, from source code related to the electronic vaping device functionality the executing the object code including verifying the DRM software stored on the reservoir memory, and based on results of the verifying the DRM software, downloading the reservoir profile information from the reservoir memory.

2. The electronic vaping device of claim 1, wherein the at least one processor is further configured to control vapor generation using the heating element and the reservoir based on the object code.

3. The electronic vaping device of claim 1, further comprising:

a charging interface configured to interface the rechargeable battery and an external power source; and the at least one processor is further configured to control charging of the rechargeable battery using the external power source through the charging interface based on the object code.

4. The electronic vaping device of claim 1, further comprising:

at least one input/output element that includes at least one of a light-emitting diode, a button, a switch, an airflow sensor, or a sub-combination thereof, or a combination thereof; and the at least one processor is further configured to control the at least one input/output element based on the object code.

5. The electronic vaping device of claim 1, wherein the object code related to electronic vaping device functionality includes computer readable instructions for at least one of:

electronic vaping device identification, powering on, powering off, power consumption, operating efficiency, heating element temperature control, reservoir pre-vapor formulation level detection, operating time, power reduction, power increase, battery charging control, user interface, communications, self-test, electronic vaping device monitoring, or a sub-combination thereof, or a combination thereof.

6. The electronic vaping device of claim 1, further comprising:

a reservoir interface configured to transfer data communications between the at least one processor and the reservoir; and wherein the reservoir includes a second memory configured to store reservoir profile information related to the pre-vapor formulation, and the at least one processor is configured to receive the reservoir profile information through the reservoir interface for storage in the first memory based on the electronic vaping operating system.

7. The electronic vaping device of claim 6, wherein the reservoir profile information includes at least one of:

pre-vapor formulation type information, pre-vapor formulation identifier, vendor identifier, capacity information, heating element configuration data, measurement capability information, deliverable function amount information, consumption capacity information, software capability information, or a sub-combination thereof, or a combination thereof.

8. The electronic vaping device of claim 1, further comprising:

a host interface configured to transfer data communications between the at least one processor and an external computing device; and the at least one processor is configured to receive data from the external computing device through the host interface for storage in the first memory based on the electronic vaping operating system.

9. The electronic vaping device of claim 8, wherein the data of the external computing device includes profile information associated with an owner of the electronic vaping device.

10. The electronic vaping device of claim 8, wherein the data received from the external computing device includes object code related to operating the electronic vaping device and the reservoir according to desired operational constraints.

11. The electronic vaping device of claim 1, wherein the housing includes a battery section and a reservoir section; and the first memory and the at least one processor are disposed in the battery section.

12. The electronic vaping device of claim 8, wherein the housing includes a battery section and a reservoir section; and the first memory and the at least one processor are disposed in the reservoir section.

13. The electronic vaping device of claim 1, wherein the object code is based on source code written using an electronic vaping programming language associated with the electronic vaping operating system.

* * * * *